US007032274B2

(12) United States Patent
Kumagai

(10) Patent No.: US 7,032,274 B2
(45) Date of Patent: Apr. 25, 2006

(54) FITTINGS FOR USE IN FILES

(75) Inventor: Junichi Kumagai, Matsudo (JP)

(73) Assignee: World Wide Stationery Manufacturing Company Limited, (HK)

( * ) Notice: Subject to any disclaimer, the term of this patent is extended or adjusted under 35 U.S.C. 154(b) by 0 days.

(21) Appl. No.: 09/906,052

(22) Filed: Jul. 17, 2001

(65) Prior Publication Data

US 2002/0050028 A1 May 2, 2002

Related U.S. Application Data

(63) Continuation of application No. 09/850,065, filed on May 8, 2001, now abandoned.

(30) Foreign Application Priority Data

Jul. 28, 2000 (JP) ..... 2000-005391
May 1, 2001 (EP) ..... 01303975

(51) Int. Cl.
*B42F 1/00* (2006.01)

(52) U.S. Cl. ..... 24/67 R; 24/24; 24/458; 24/704.1

(58) Field of Classification Search ..... 24/67 R, 24/67.11, 457, 67.3, 67.5, 458, 703.1–704.2; 29/426.4, 426.5, 426.6, 525.06; 411/525–527, 411/163, 164; 281/21.1, 36, 27.3, 45; 402/75
See application file for complete search history.

(56) References Cited

U.S. PATENT DOCUMENTS 643,045 A * 2/1900 Denis
1,175,550 A * 3/1916 Murray
1,516,109 A * 11/1924 McBee
1,675,277 A * 6/1928 Roe
1,792,740 A * 2/1931 Hayden
2,716,985 A * 9/1955 Wolf
3,322,128 A * 5/1967 Monahan et al.
4,295,747 A * 10/1981 Errichiello
5,718,530 A * 2/1998 Tibbetts
5,988,926 A * 11/1999 Kiyomi

FOREIGN PATENT DOCUMENTS

DE 196 02 813 A1 8/1996
EP 0 725 221 A1 8/1996
GB 219 478 A 7/1924
JP 9-071082 3/1997

* cited by examiner

*Primary Examiner*—James R. Brittain
(74) *Attorney, Agent, or Firm*—Hall, Vande Sande & Pequignot

(57) ABSTRACT

There is disclosed a metal fitting (100, 100*a*, 100*b*, 200) adapted to be secured to a base member (200) by at least an eyelet (102, 102*a*, 102*b*) or a rivet (222), in which the metal fitting (100, 100*a*, 100*b*, 200) includes at least an aperture (106, 106*a*, 106*b*, 214) adapted to receive at least part of the eyelet (102, 102*a*, 102*b*) or rivet (222), in which at least one tab (108, 110, 108*a*, 108*b*, 216) extends from a periphery of the aperture (106, 106*a*, 106*b*, *214*) into the aperture, and the tab (108, 110, 108*a*, 108*b*, 216) is adapted to engage with a flared portion (112, 112*a*, 112*b*) of the eyelet (102, 102*a*, 102*b*) or rivet (222) to secure the metal fitting (100, 100*a*, 100*b*, 200) with the base member (200). There is also disclosed a document holder formed of such a metal fitting as attached to a base member.

3 Claims, 14 Drawing Sheets

PRIOR ART

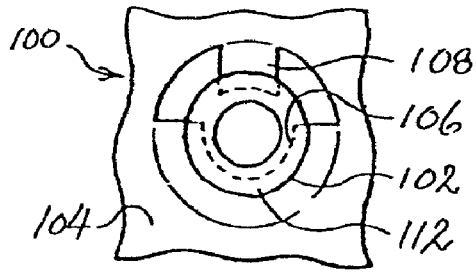
Fig.4A(ii)
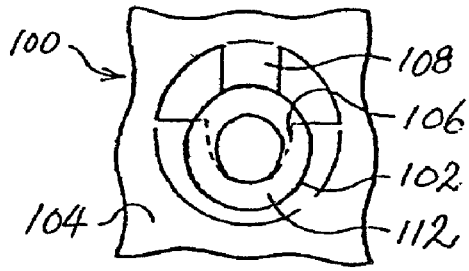
Fig.4B(ii)
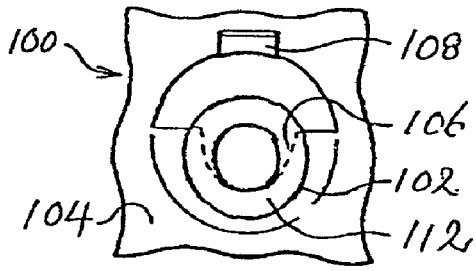
Fig.4C(ii)
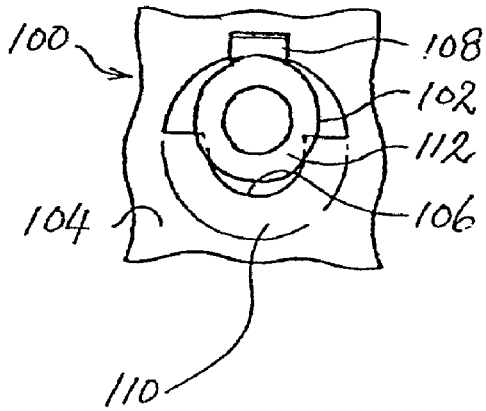
Fig.4D(ii)

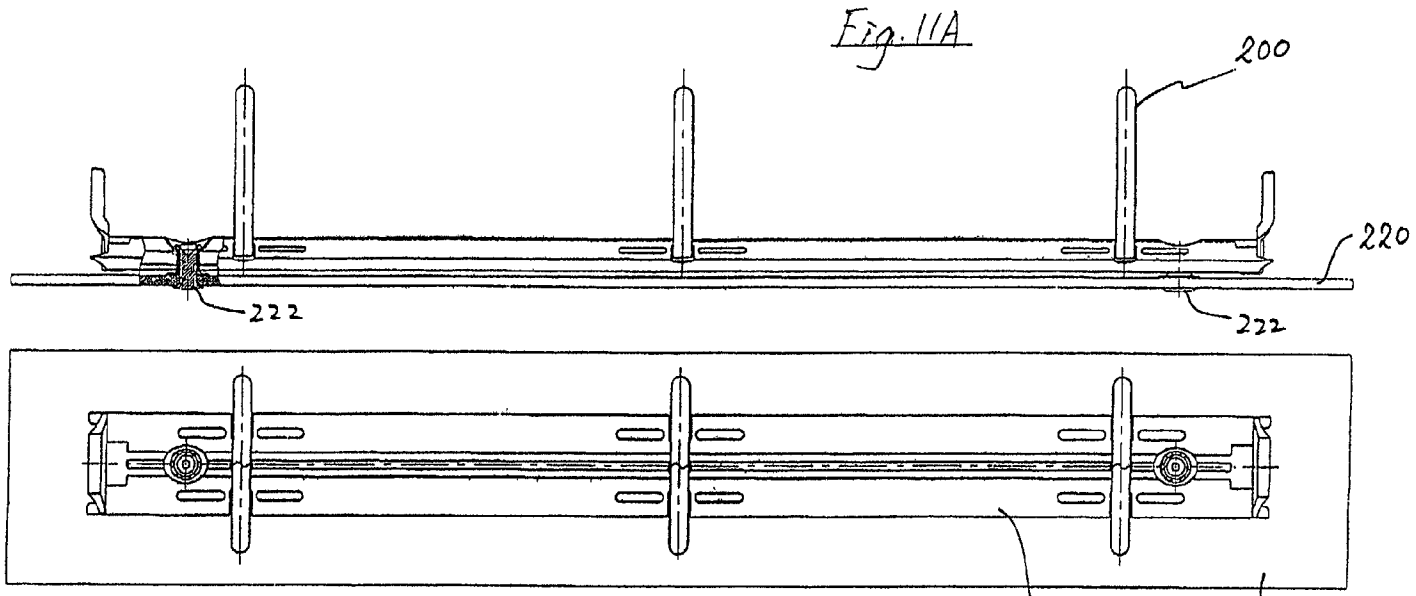
Fig. 11A
Fig. 11B
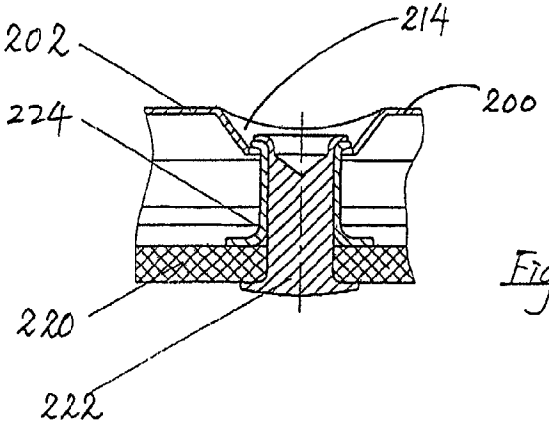
Fig. 11C

FITTINGS FOR USE IN FILES

This application is a continuing application and claims benefit under 35 U.S.C. §120 to the filing date of U.S. application Ser. No. 09/850,065, filed May 8, 2001 now abandoned.

This invention relates to a fitting for holding documents, and in particular such a fitting adapted to hold documents and be secured to a base article, and a document holder with such a fitting secured to a base article.

BACKGROUND OF THE INVENTION

FIG. 1 is a perspective view of the way in which a prior art metal file fitting, generally designated as 1, has up to now generally been attached to a file 3 made of cardboard. FIG. 2 is an enlarged view of a part of the prior art metal file fitting 1 shown in FIG. 1. In the case of the prior art metal fitting 1 herein, for example, the fold at each end of a metal document retention bracket 1*c*, which has the shape of a rectangle with the left-hand end open, is attached to a lateral edge 1*b* of a rectangular stainless base 1*a* by means of a tensioning coil spring 1*d*. Near each longitudinal end of the rectangular stainless base 1 a is a small hole 1*e* into which a respective eyelet 2 can be inserted. The eyelets 2 are tube-shaped metal parts inserted into the small holes 1*e* made in the metal fitting 1 and the file 3, and pressed through from one end to form a joint between the holes.

In recent years the disposal of manufactured goods has become an issue. For example, when disposing of files with the prior art metal fitting 1 attached, the metal fitting 1, which cannot be incinerated, has to be removed from the cardboard file 3, which is combustible, and destroyed separately.

For this reason, when removing the prior art metal fitting 1 from the cardboard file 3, such measures as filing off the flared part of the eyelets 2 had to be used, making the process complicated.

It is thus an object of the present invention to provide a novel fitting for use in files which simplifies the detachment of the fitting from the file when the part of the file made of cardboard or plastic and its metal part are separated for disposal.

It is a further object of the present invention to provide a novel fitting for use in files that can be removed from a file relatively easily, even without resorting to measures such as filing down the flared part of the eyelet.

It is a yet further object of the present invention to provide a file incorporating such a novel fitting.

SUMMARY OF THE INVENTION

According to a first aspect of the present invention, there is provided a document holding mechanism adapted to be secured to a base member by at least one securing member, wherein said mechanism includes at least an aperture adapted to receive at least part of said securing member, wherein at least one engagement member extends from a peripheral edge of said aperture into said aperture, said engagement member being adapted to engage with a flared portion of said securing member to secure said mechanism with said base member, and wherein said engagement member comprises a first and a second major surface, and at least part of said first major surface of said engagement member is adapted, in use, to be in abutment with said flared portion of said securing member.

According to a second aspect of the present invention, there is provided a document holder including a document holding mechanism secured to a base by at least one securing member, wherein said mechanism includes at least an aperture receiving at least part of said securing member, wherein at least one substantially continuous engagement member extends from a periphery of said aperture into said aperture, said engagement member being engaged with a flared portion of said securing member to secure said mechanism with said base member, and wherein said engagement member comprises a first and a second major surface, and at least part of said first major surface of said engagement member is in abutment with said flared portion of said securing member.

BRIEF DESCRIPTION OF THE DRAWINGS

Embodiments of fittings according to the present invention will now be described, by way of examples only, and with reference to the accompanying drawings, in which:

FIG. 11A is a side view of the ring binder mechanism shown in FIG. 6 as attached to a cardboard, in which part of the interior part of the ring binder mechanism is shown;

FIG. 11B is a top view of the ring binder mechanism and cardboard shown in FIG. 11A;

FIG. 11C is an enlarged view of the interior part shown in FIG. 11A.

DETAILED DESCRIPTION OF PREFERRED EMBODIMENTS

Figure 1:
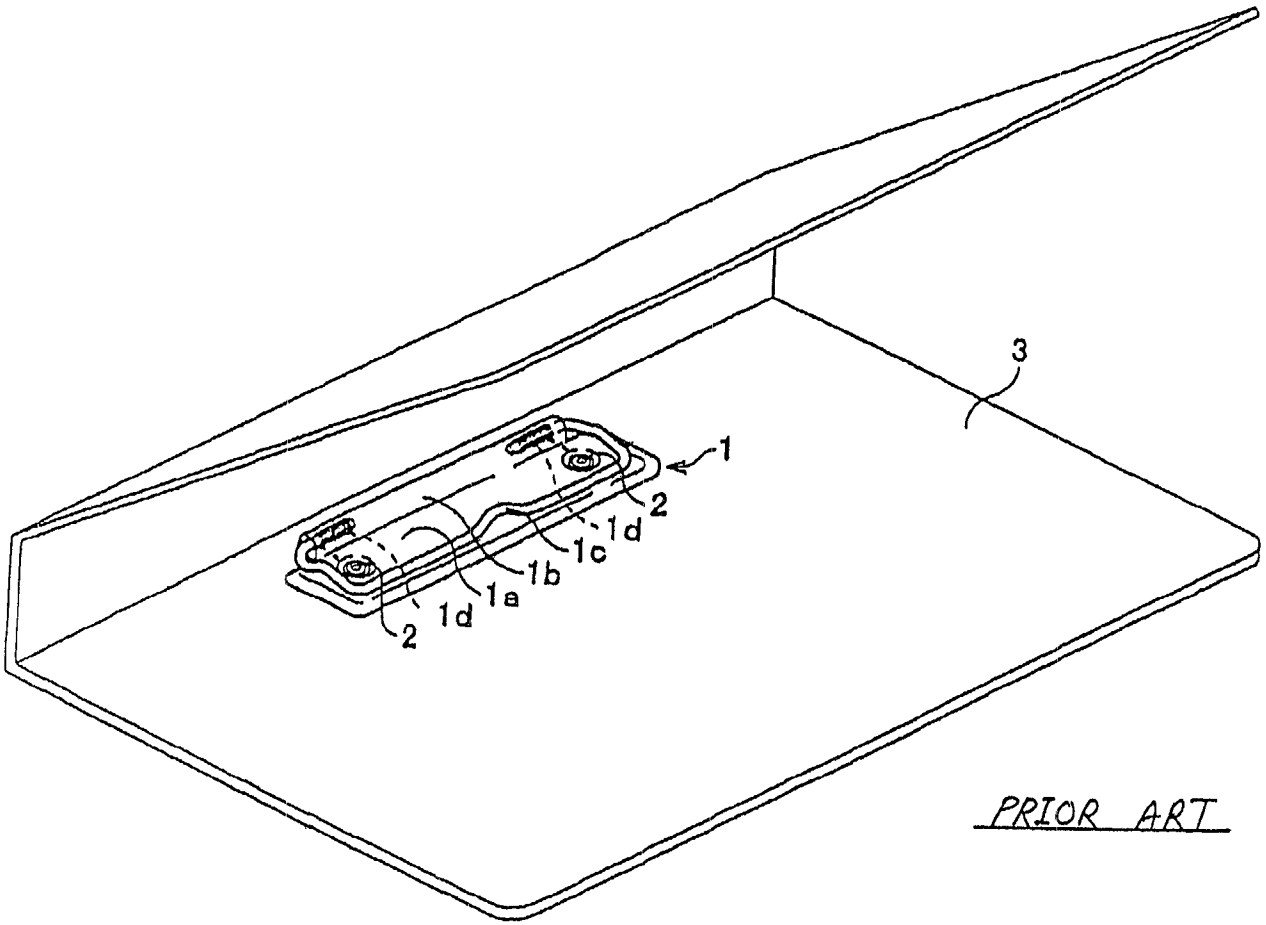
FIG.1 is a perspective view of a prior art metal file fitting attached to a file.
Figure 2:
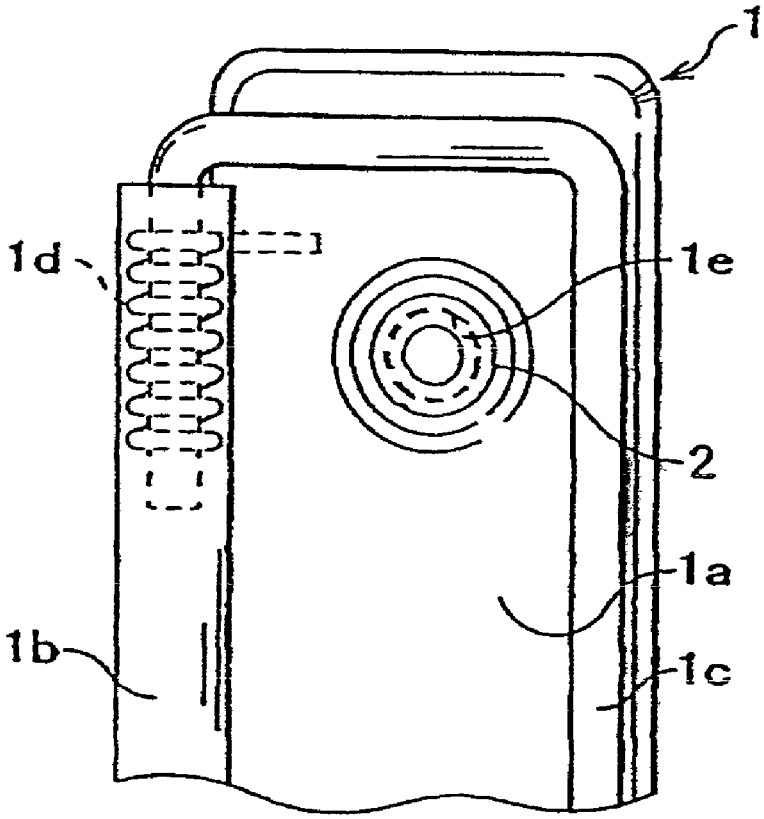
PRIOR ART Fig. 2
FIG. 2 is an enlarged view showing a part of a prior art metal file fitting shown in FIG. 2.
Figure 3:
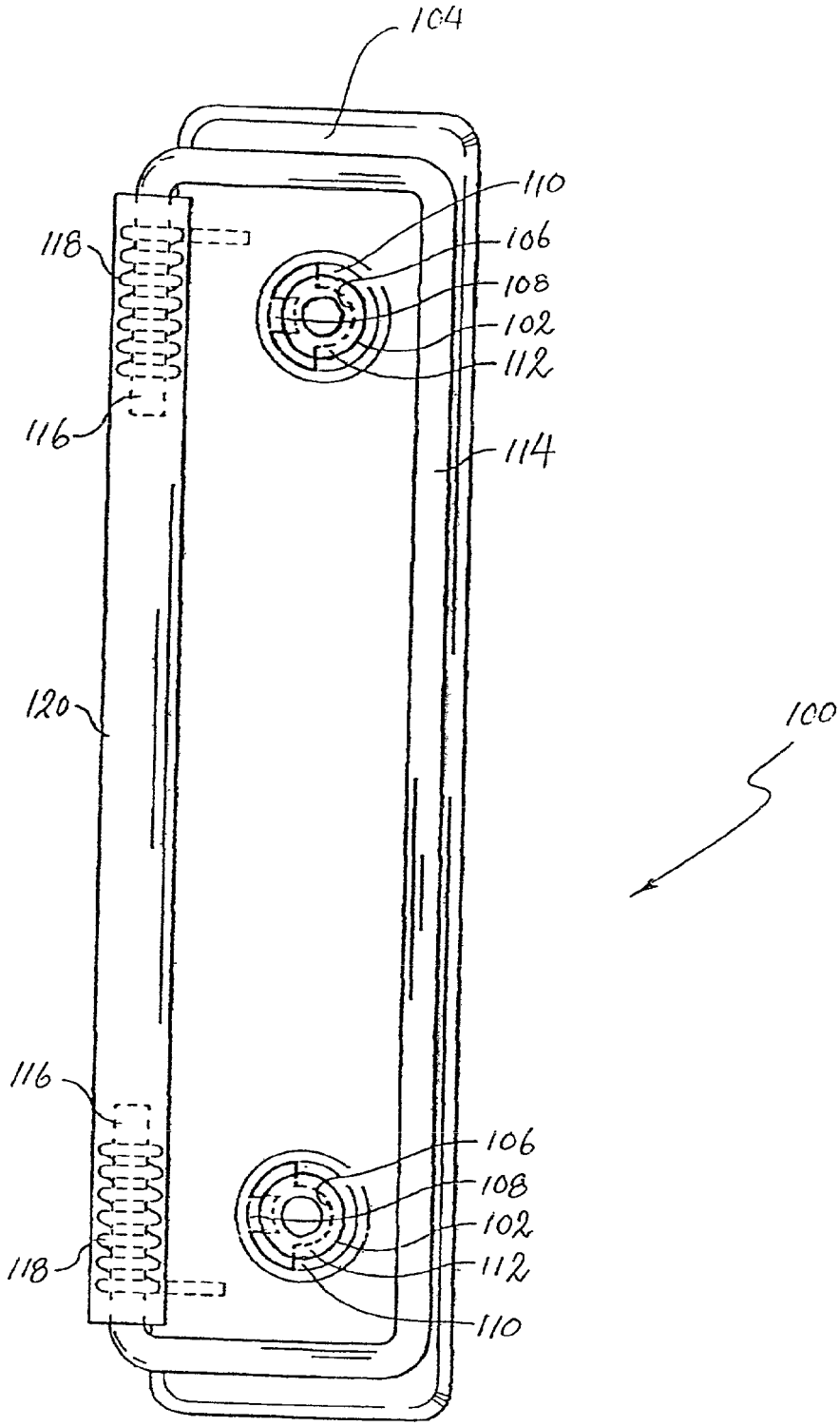
FIG. 3 is a plan view of a first embodiment of a file fitting according to the present invention.

In order to solve or at least to mitigate the problem discussed above, in a metal fitting 100 in the form of a document holding mechanism according to the present invention, and as shown in FIG. 3, a shaft of an eyelet or rivet 102 is inserted through a hole in a base cover (not shown) into a rectangular metal base 104 of the metal fitting 100, which may be made of stainless steel or other metal. The metal base 104 is formed with two apertures 106, each having a generally rectangular tab 108 and a generally semi-circular tab 110 extending into the aperture 106 from a periphery thereof. The tabs 108, 110 are formed integrally with the metal base 104. A flared upper part 112 of the eyelet 102, which may be formed by deformation of an upper end of the eyelet 102, catches the rectangular tab 108 and the semi-circular tab 110 so that the eyelet 102 cannot be withdrawn from the metal fitting 100. Another end of the eyelet 102 may be formed a head which engages the base cover.

By adopting this pattern of the aperture 106, when the metal fitting 100 is to be removed, the rectangular tab 108 in the aperture 106 can be prised upwards by using a tool with a sharp point (such as a screwdriver) so that the flared part 112 of the eyelet 102 can be easily withdrawn, enabling the removal of the metal fitting 100 from the base cover.

The fitting 100 includes a metal document retention bracket 114, which is shaped like a rectangle with the left-hand end open. Folds 116 at both ends of the retention bracket 114 are attached by means of a respective tensioning spring 118 to a lateral edge 120 of the metal base 104.

Figure 4A:
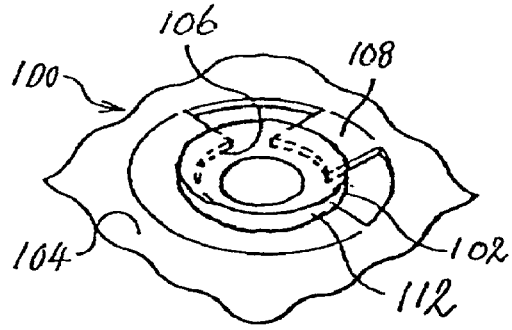
FIGS. 4A(i) to 4D(ii) show steps whereby the file fitting shown in FIG. 3 is removed from a file.

FIGS. 4A(i) to 4D(ii) show the steps for removing the metal file fitting 100 from the file. FIGS. 4A(i) and 4A(ii) are respectively an oblique perspective view and a plan view illustrating the position when the shaft of the eyelet 102 has been inserted into the aperture 106. The flared part 112 of the eyelet 102 is anchored by the rectangular tab 108 in the aperture 106 so that the eyelet 102 is secured to the metal base 104.

Figure 4B:
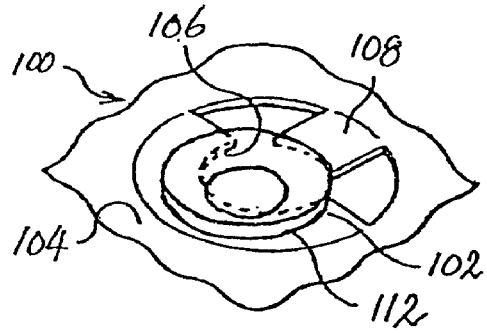

When the metal fitting 100 is to be removed from the file, as is shown by an oblique perspective view FIG. 4B(i) and a plan view FIG. 4B(ii), the fitting 100 may be moved, e.g. being pushed, relative to the base cover, so that the tip of the tab 108 in the aperture 106 formed in the fitting 100 approaches the rim of the flared part 112 of the eyelet 102.

Figure 4C:
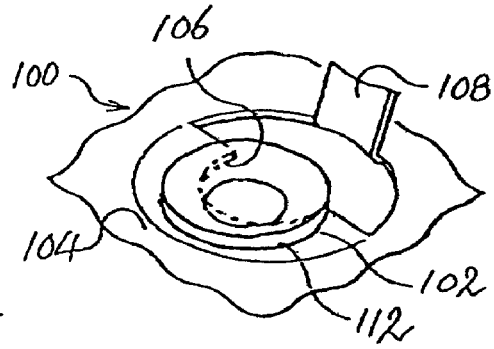
Figure 4D:
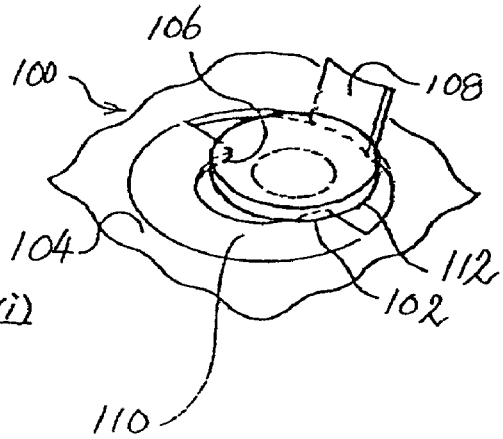

Then, and as shown in an oblique perspective view FIG. 4C(i) and a corresponding plan view FIG. 4C(ii), the tab 108 in the aperture 106 is prised up with a sharp-pointed tool, e.g. a screwdriver. Subsequently, as shown in an oblique perspective view FIG. 4D(i) and a corresponding plan view FIG. 4D(ii), the metal file fitting 100 is moved back so that the rim of the flared part 112 of the eyelet 102 approaches the tab 108 that has been prised up as described above. To the extent necessary, the part of the semi-circular tab 110 that is engaged with the flared part 112 of the eyelet 102 can be prised up with a sharp-pointed instrument, so as to be disengaged from the eyelet 102. The fitting 100 may then be removed from the base cover, e.g. by being prised by the same sharp-pointed tool.

When it comes to prising up the above flared part 112, it is also possible, as shown in FIGS. 4B(i) and 4B(ii), to do this without moving the metal file fitting 100.

Figure 5A:
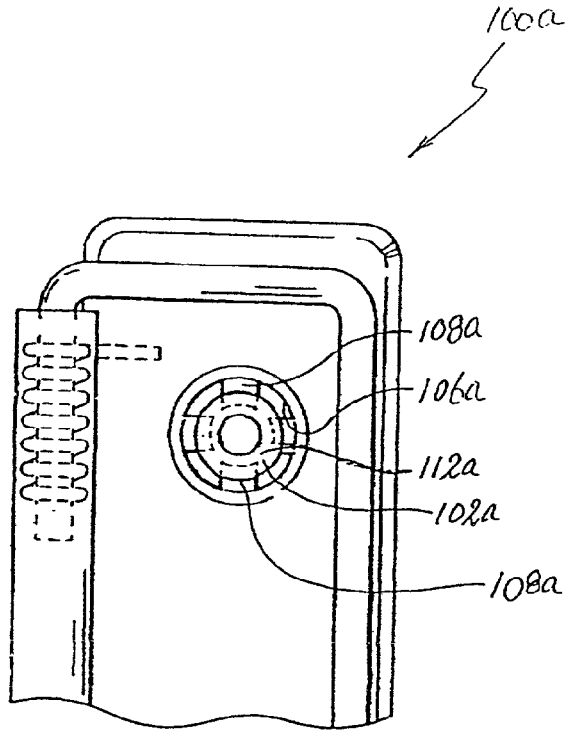
FIG. 5 is a perspective view showing other forms of application of the metal file fitting shown in FIG. 3.

FIG. 5A shows an example of a variation of a fitting 100*a*, in which the number of tabs 108*a* in the aperture 106*a* differs from that of the fitting 100 discussed above. In this example, there are formed four tabs 108*a*, which are disposed equidistantly around the inner periphery of the aperture 106*a*. When the metal file fitting 100*a* is to be removed, the four tabs 108*a* are prised upwards with a sharp-pointed instrument. The tabs 108*a* are then disengaged from a flared part 112*a* of an eyelet 102*a*. The metal file fitting 100*a* may then be prised away from the file at roughly right angle relative to the file and can be easily removed.

Figure 5B:
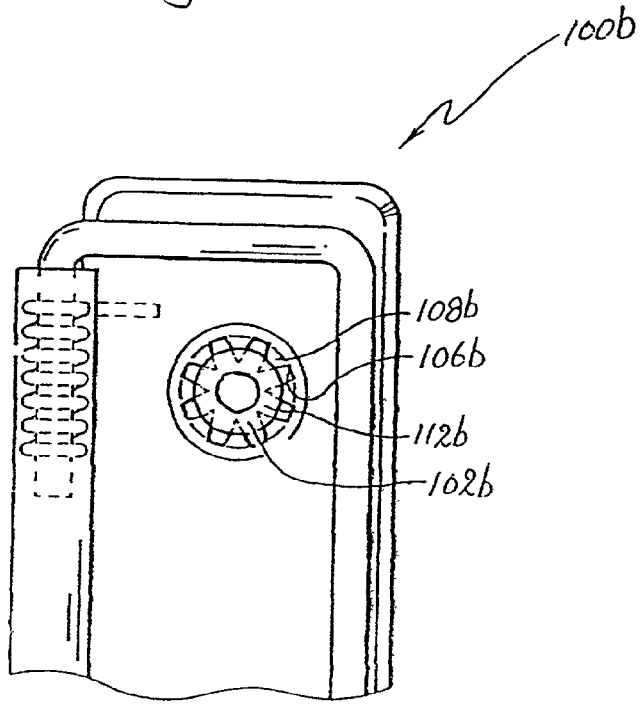

FIG. 5B shows another example of a variation of a fitting 100*b*, in which both the number and shape of tabs 108*b* extending into an aperture 102*b* differ from those of the metal fittings 100, 100*a* discussed above. In this example, eight peak-shaped tabs 108*b* are formed. The peak-shaped tabs 108 are generally triangular in shape with a vertex thereof pointing towards a centre of an aperture 106*b*. When the metal file fitting 100*b* is to be removed, the peak-shaped tabs 108*b* are prised upwards with a sharp-pointed instrument, so as to disengage the tabs 108*b* from a flared part 112*b* of an eyelet 102*b*. The metal file fitting 100*b* may then be prised upwards at a generally right angle to the file and can be easily removed. By adopting this peak-shaped configuration, the tabs 108*b* are easier to prise upwards.

As has been explained above, with a metal file fitting made in accordance with the present invention, that is to say where the shaft of an eyelet can be inserted into an aperture of a rectangular metal base of the metal file fitting, which aperture having at least one tab onto which the flared part of the eyelet catches, so as to prevent withdrawal, the flared part of the eyelet can be easily withdrawn by prising up one or more of the tab(s) extending into the aperture, the metal file fitting can be conveniently removed from the file.

While the present invention has hitherto been described in the context of document holding mechanisms having a spring-loaded document retention bracket engaged with a metal base, the present invention may also be incorporated in ring binder mechanisms, to be further described below.

Figure 6:
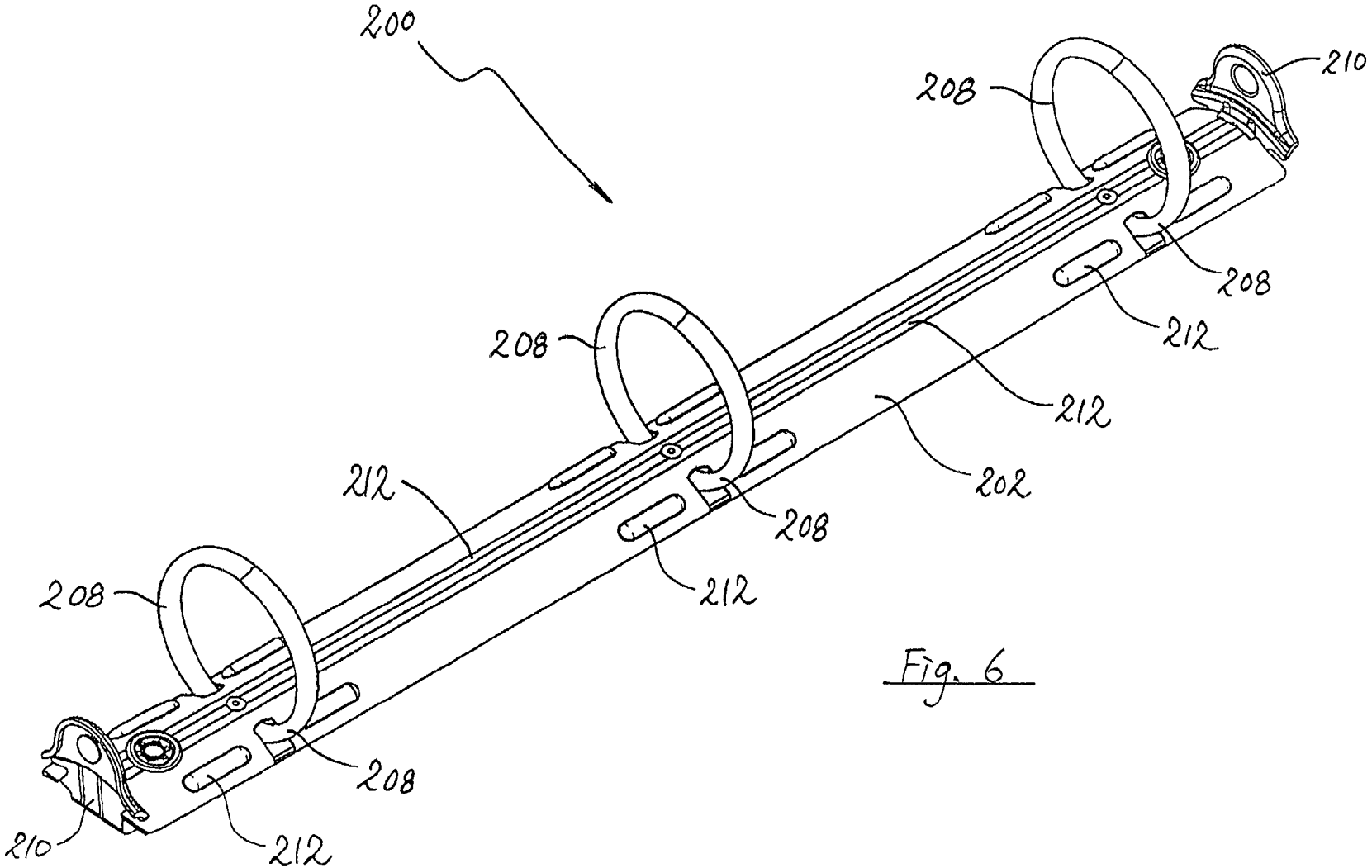
FIG. 6 is a top perspective view of a second embodiment of a file fitting in the form of a ring binder mechanism according to the present invention, in which the ring binder mechanism is in a ring-closed configuration.
Figure 7:
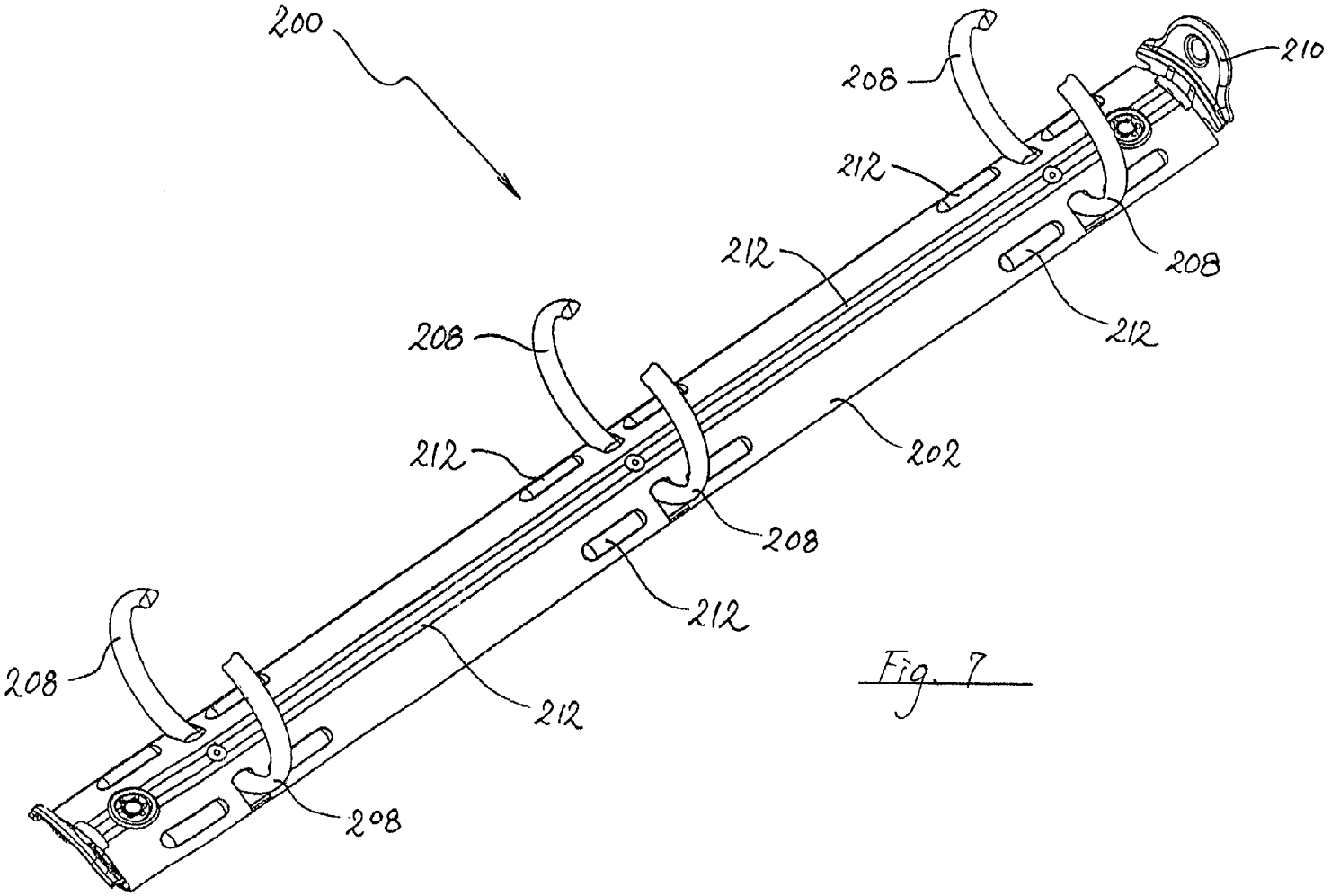
FIG. 7 is a top perspective view of the ring binder mechanism shown in FIG. 6 in a ring-open configuration.
Figure 8C:
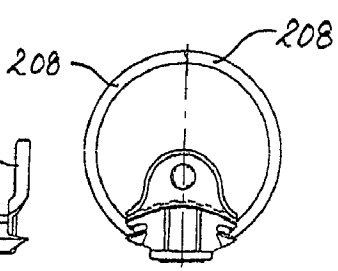
FIG. 8C is an end view of the ring binder mechanism shown in FIG. 6.
Figure 8A:
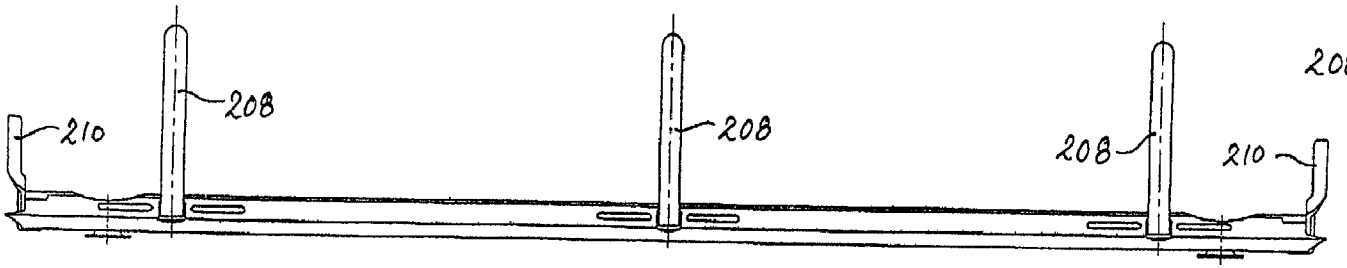
FIG. 8A is a side view of the ring binder mechanism shown in FIG. 6.
Figure 8B:
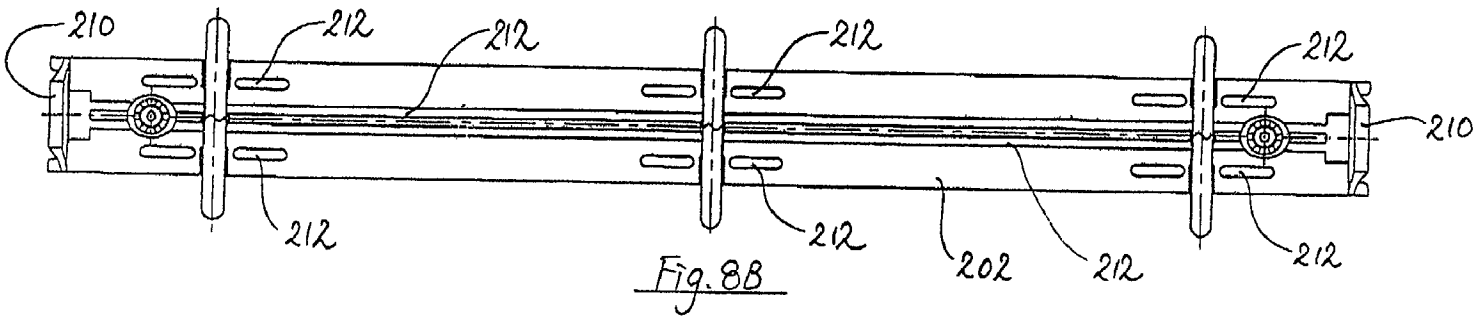
FIG. 8B is a top view of the ring binder mechanism shown in FIG. 6.
Figure 8D:
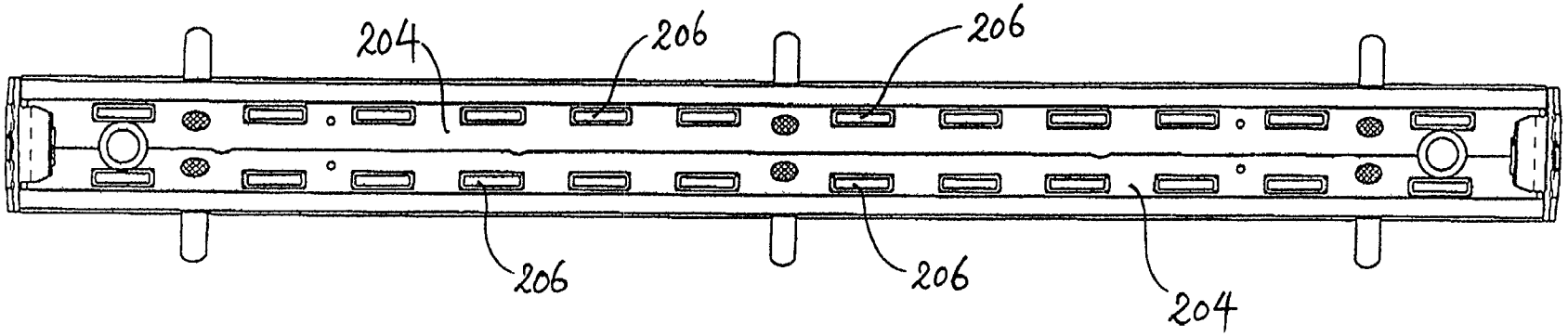
FIG. 8D is a bottom view of the ring binder mechanism shown in FIG. 6.
Figure 9:
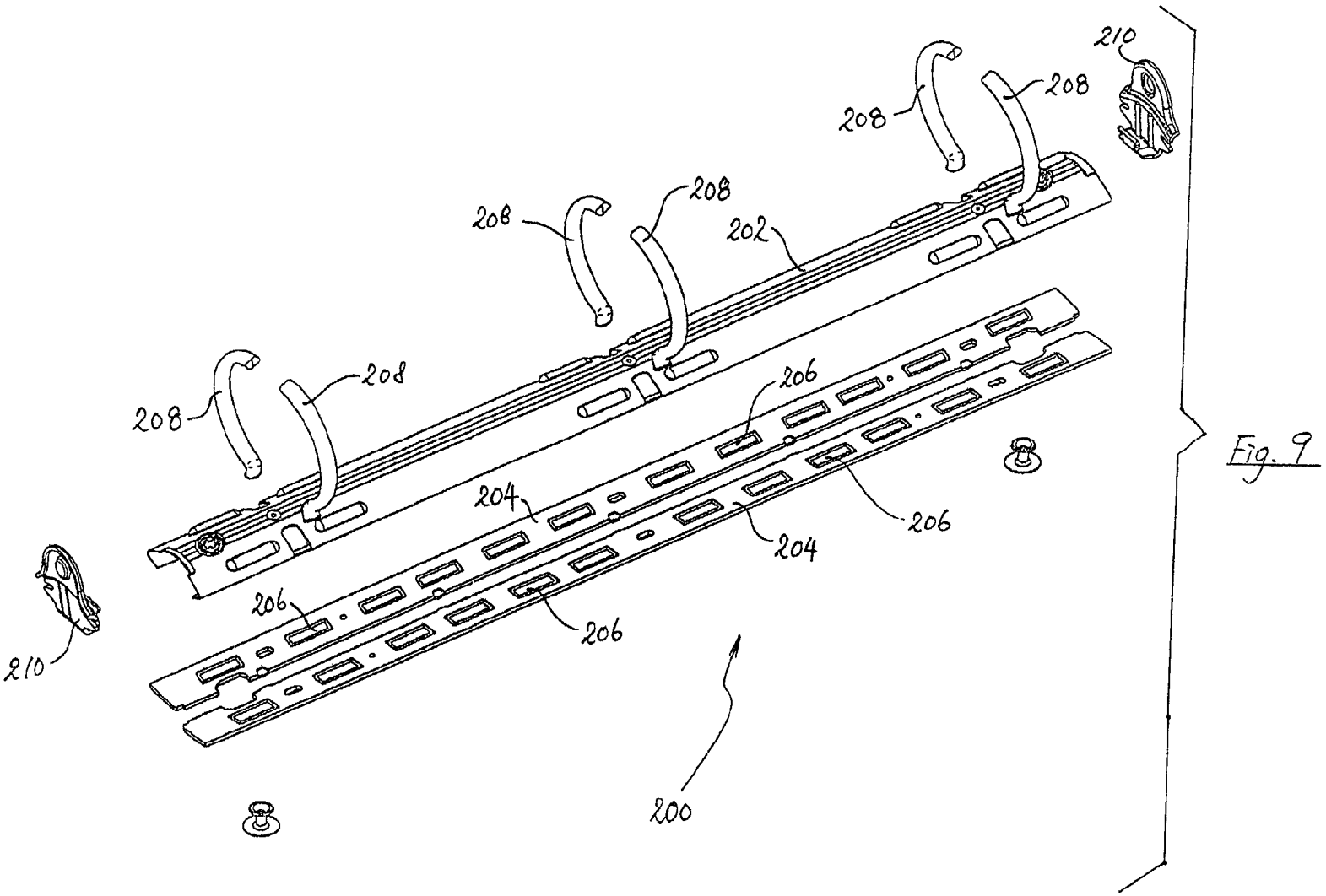
FIG. 9 is an exploded view of the ring binder mechanism shown in FIG. 6.

A ring binder mechanism constructed in accordance with the present invention is shown in FIGS. 6 to 9, and generally designated as 200. The ring binder mechanism 200 is made of steel with nickel plating, and includes an upper casing 202 which supports a pair of carrier plates 204 for pivotal movement. As can be seen in FIGS. 8D and 9, in order to strengthen the carrier plates 204, a number of generally rectangular recesses 206 are formed on the major surfaces of the carrier plates 204. To the carrier plates 204 are fixedly secured a number of half-rings 208. As the half-rings 208 are fixedly secured to the carrier plates 204, when the carrier plates 204 are pivoted relative to each other, e.g. by moving a pair of levers 210 situated at two longitudinal ends of the ring binder mechanism 200, the half-rings 208 will change between an open configuration (as shown in FIG. 7) in which loose-leaf sheets may be inserted into or retrieved from the half-rings 208, and a closed configuration (as shown in FIG. 6) in which loose-leaf sheets may be retained by the half-rings 208. In addition, in order to strengthen the upper casing 202, a number of ridges 212 running parallel to the longitudinal axis of the upper casing 202 are formed on the casing 202.

Figure 10A:
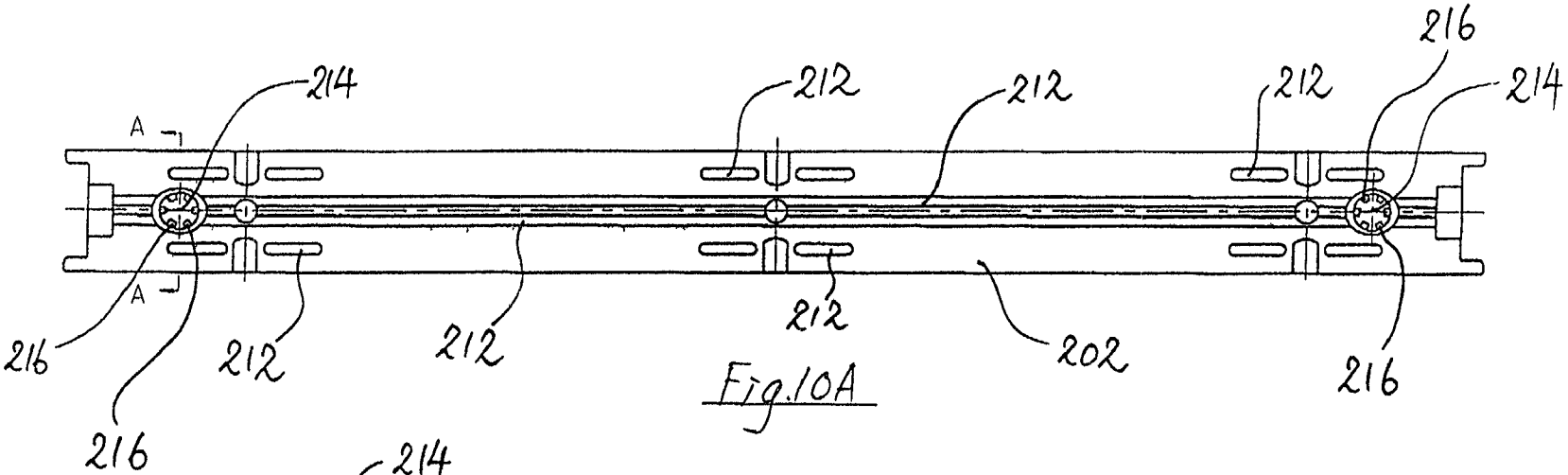
FIG. 10A is a top view of a upper casing of the ring binder mechanism shown in FIG. 6.
Figure 10B:
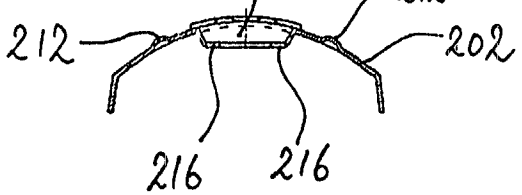
FIG. 10B is a sectional view of the upper casing taken along the line A—A in FIG. 10A.

As can be seen in FIGS. 10A and 10B, adjacent each longitudinal end of the upper casing 202 is a hole 214. A number of tabs 216 extend from the inner periphery of each hole 214 and towards the respective centre.

The ring binder mechanism 200 may be secured to a base article, e.g. a cardboard 220, by two rivets 222. As is more clearly shown in FIG. 11C, each rivet 222 is secured to the upper casing 202 of the ring binder mechanism 200 via an intermediate bushing 224. Both the rivet 222 and the bushing 224 have a flared upper part, which are formed by deformation of the upper end of the rivet 222 and that of the bushing 224. The rivet 222 is inserted through a hole of the cardboard 220. The flared upper part of the rivet 222 and the bushing 224 are thus engaged with the tabs 216, so that the upper casing 202, the bushing 224, the cardboard 220, and the rivet 222 are secured with one another. In particular, the rivet 222 is engaged with the tabs 216 of the upper casing 202 indirectly, i.e. via the bushing 224.

Figure 12:
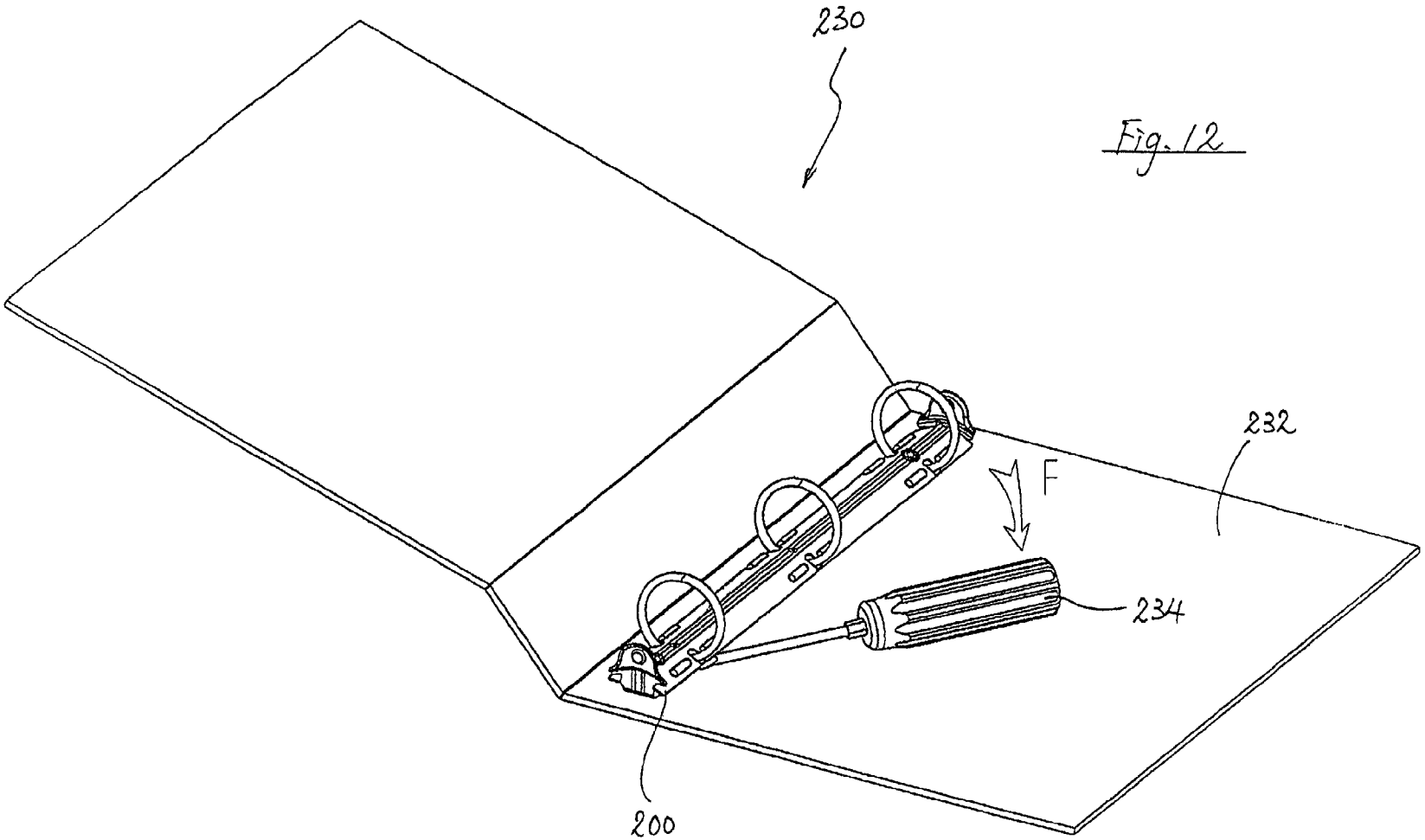
FIG. 12 is a perspective view showing a ring binder incorporating a ring binder mechanism shown in FIG. 6.

A document holder in the form of a ring binder, generally designated as 230, is shown in FIG. 12 as incorporating the ring binder mechanism 200. The ring binder mechanism 200 is secured to a cover 232, which may be made of plastics or cardboard, in the manner discussed above. To remove the ring binder mechanism 200 from the ring binder 230, one first loosens the engagement between the rivet 222 and the tabs 216, in the manner discussed above and shown in FIGS. 4A(i) to 4D(ii). A sharp implement, e.g. a screwdriver 234, may then be forced between the ring binder mechanism 200 and the cover 234. With the tip of the screwdriver 234 acting as a fulcrum, the screwdriver 234 may pivot in the direction indicated by the arrow F, so as to prise up, and thus remove, the ring binder mechanism 200 from the cover 234.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. A document holding mechanism adapted to be secured to a base member by at least one securing member, wherein said mechanism includes at least an aperture adapted to receive at least part of said securing member, wherein at least two engagement members extend from a peripheral edge of said aperture into said aperture, each of said engagement members having side surfaces and wherein said side surfaces of said engagement members are oriented non-parallel to said peripheral edge of said aperture, said engagement members being adapted to engage with a flared portion of said securing member to secure said mechanism with said base member, and wherein each said engagement member further comprises a first and a second major surface, and at least part of said first major surface of each said engagement member is in abutment with said flared portion of said securing member, wherein a plurality of said engagement members are movable relative to a body member of said mechanism to allow detachment of said mechanism from said securing member.

2. A document holding mechanism adapted to be secured to a base member by at least one securing member, wherein said mechanism includes at least an aperture adapted to receive at least part of said securing member, wherein at least two engagement members extend from a peripheral edge of said aperture into said aperture, each of said engagement members having side surfaces and wherein said side surfaces of said engagement members are oriented non-parallel to said peripheral edge of said aperture, said engagement members being adapted to engage with a flared portion of said securing member to secure said mechanism with said base member, and wherein each said engagement member further comprises a first and a second major surface, and at least part of said first major surface of each said engagement member is in abutment with said flared portion of said securing member, and wherein at least two differently shaped tab members comprise two or more of said engagement members.

3. A mechanism according to claim 2 wherein one of said tab members is generally rectangular.

* * * * *